United States Patent [19]

Hird

[11] 4,435,939

[45] Mar. 13, 1984

[54] PANEL LOCKING MEANS

[75] Inventor: Richard E. Hird, Catlin, Ill.

[73] Assignee: Estad Products, Inc., Danville, Ill.

[21] Appl. No.: 178,539

[22] Filed: Aug. 15, 1980

[51] Int. Cl.[3] ..... E04C 1/10

[52] U.S. Cl. ..... 52/582; 52/127.7

[58] Field of Search ..... 52/309.2, 127, 584, 52/582, 706, 583; 70/466

[56] References Cited

U.S. PATENT DOCUMENTS

| | | | |
|---|---|---|---|
| 2,280,080 | 4/1942 | Predan | 52/706 |
| 3,392,497 | 7/1968 | Cushman | 52/584 |
| 3,400,958 | 9/1968 | Haimes | 52/584 |
| 3,496,692 | 2/1970 | Melcher | 52/583 |
| 3,587,199 | 6/1971 | Henry | 52/582 |
| 4,045,927 | 9/1977 | Diaz | 52/127 |

*Primary Examiner*—John E. Murtagh

*Attorney, Agent, or Firm*—Allegretti, Newitt, Witcoff & McAndrews Ltd.

[57] ABSTRACT

A supporting means for panel locking elements used generally for securing a pair of adjacent building sections or insulated panels together, including a housing member disposed within an insulated panel with means for supporting and positioning the housing means, which supporting means include portions which engage with relatively rigid sidewalls of the panel and are positively positioned or locked with respect thereto.

9 Claims, 13 Drawing Figures

PANEL LOCKING MEANS

BACKGROUND OF THE INVENTION

1. Field of the Invention

The invention is used in the field of fabricated enclosures, particularly heavily insulated enclosures such as freezers, refrigerators and the like, although the construction may be used for many other purposes. More particularly, the invention relates to the supporting means for a latch mechanism for joining abutting panels or sections of such a structure together, which latch mechanism clamps the sections firmly together and provides sealing pressure to prevent leakage through the abuttments.

2. Description of the Prior Art

In various commercial and industrial installations, the requirements for insulated enclosures may exceed the dimensions of normal structures or of the usual industrial cooler units, for example. In such cases, the insulated enclosure is manufactured of panels or sections which may be added one to another until it is of a size to meet the requirements. The use of interlocking sections provides a high degree of flexibility and the joints must be properly aligned and sealed so as to avoid leakage. In order to provide such a construction, latching means for the interlocking panels have been heretofore utilized, such as that shown, for example, in William O. Burke, U.S. Pat. No. 3,191,244 issued June 29, 1965 for Sectional Cooler Latch. Similar latches have been secured to interlocking sections as shown in FIGS. 2 and 3 of the drawings of the present application.

In such contructions, extensions have been secured to housings which support the complementary latching devices, wherein both the extensions and the housings are formed from metal stampings, and the extensions are imbedded in the usual insulating material which is retained between opposite relatively rigid walls of the sections. The disadvantage of such construction is that the insulation which is usually cast or molded foam, may weaken, particularly as it ages, because of dehydration or other deleterious effects and, as a result, the material which is intended to secure the housing for the latching members in correct position becomes loosened and the latches, as a result, do not maintain the sections in the tight contact which is required for this type of contruction.

The present invention provides improved constructions for positively locating the housings for the cooperating latching members of such insulated panels in positive relative position with each other and with the walls of the panels, so that there can be no displacement or movement of the latch supporting housings regardless of the condition of the insulating material of each section.

It is, therefore, an object of the invention to provide supporting means for the housings which support the latching mechanisms of insulated panels of building material which are to be secured together in such a manner that they are substantially permanently positioned so that, regardless of the stresses placed thereon or the condition of the insulating material therein, the housings will always be properly aiigned and positioned and, as a result, the cooperating latching members in adjacent panels will always properly engage and latch the panels in tight relationship.

SUMMARY OF THE INVENTION

The invention provides latch supporting means for latching adjacent panels of an insulated construction together which provides for positively positioning and aligning the housings supporting the latching mechanisms of adjacent panels regardless of the condition of the insulating material which is positioned between relatively rigid walls of each panel.

DESCRIPTION OF THE PREFERRED EMBODIMENTS

Figure 1:
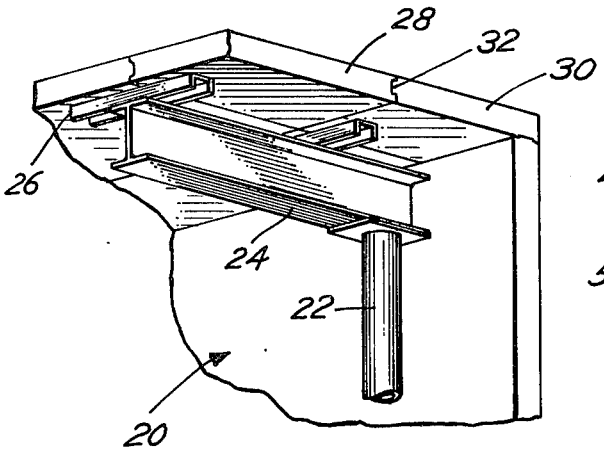
FIG. 1 is a partial perspective view of a typical building or cooler construction with sectional paneling and shows one type of supporting means for the sections of insulating material.

FIG. 1 is a partial perspective view of the sectional panelling and shows separate insulated panels 28 and 30 which are tightly secured together at 32, as is well known in the art. The panels 28 and 30 form a part of an enclosure 30 which may be an insulated building or may be a refrigerated cooler. Upright supporting members 22 engage with I-beams 24 to support the same, which in turn support channel members 22 on which the panels 28 and 30 are in turn supported.

Figure 2:
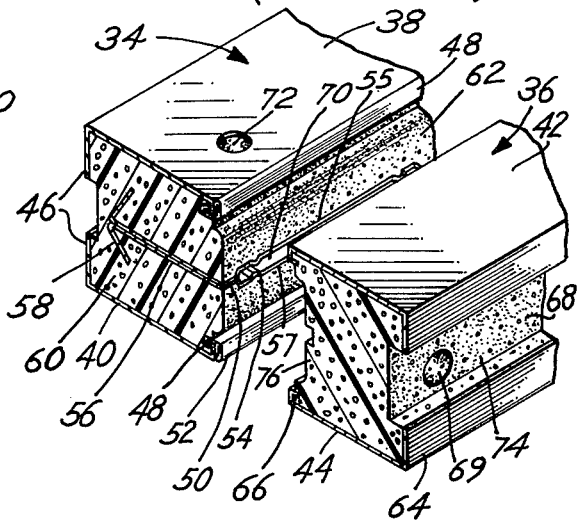
Fig. 2 (PRIOR ART)
FIG. 2 is an exploded perspective view showing adjacent insulated sections as previously constructed.
Figure 3:
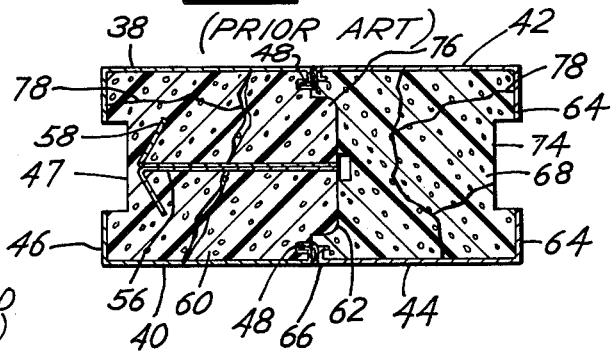
Fig. 3 (PRIOR ART)
FIG. 3 is a sectional view showing the two sections or panels of FIG. 2 in their assembled condition.

FIGS. 2 and 3 illustrate a prior art construction. In such construction, a pair of insulated panels, generally indicated at 34 and 36, are adapted to be connected together as shown in FIG. 3. Panel 34 comprises an upper substantially rigid wall 38 and a similar lower wall 40, which walls may be preferably of metal or of any other suitable, fairly rigid, material. The walls 38 and 40 are provided with solid heat insulating material 40 which may be preformed by molding, casting or machining into blocks of the desired shape. The adjacent panel 36 includes a top wall 42 and a bottom wall 44 with insulation 68 therebetween. The material of the walls and the insulation may be the same or similar to that shown in the panel 34.

Referring again to panel 34, the top wall member 38 and the bottom wall member 40 are provided at one edge thereof with right angle flanges 48 which engage with insulating material 60. A U-shaped channel 47 is provided in the insulation 40 adjacent flanges, or inturned portions, 46 for the reception of a portion of an adjacent panel member. The panel 34 also includes grooved channel members 48 on the edges of the walls 38 and 40 opposite the flanges 46. An insulating gasket 48 formed of rubber, or similar deformable material, is secured externally of the channels 48 in order to engage with cooperating channels 66 provided on the walls 42 and 44 of the adjacent panels 36. Panel 36 is likewise provided with right angled flanges 64 extending toward each other at one edge thereof opposite the grooves or channel members 66. The insulation 68 disposed between the walls 42 and 44 is provided with a U-shaped channel 74, again to accommodate an adjacent panel of material which may, in some cases, be bolted to the assembled panels 38 and 42 through a hole 69, such as shown in FIG. 2.

Figure 13:
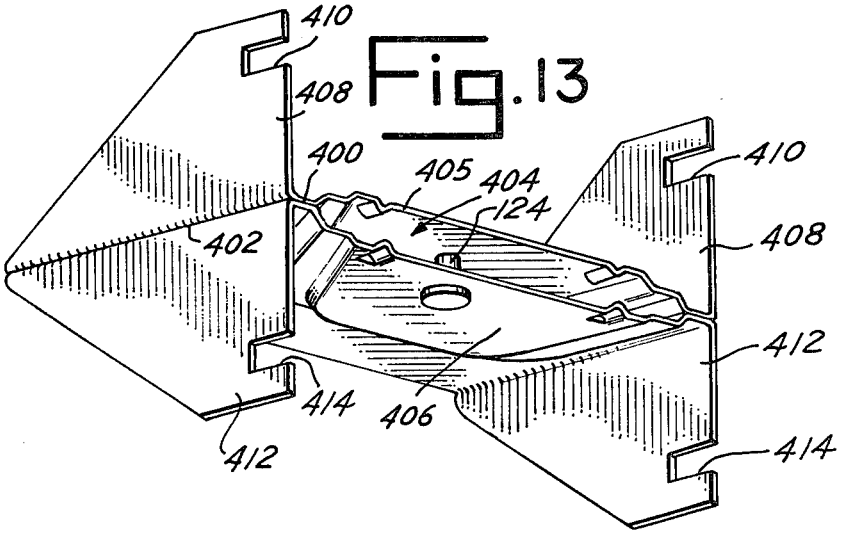
FIG. 13 is a perspective view of still another embodiment of the invention showing the latch supporting housing and the positioning members secured thereto for engagement with the walls of the insulated panels of the type shown in FIG. 4, for example.

A latch supporting houshing 54, preferably formed of a metal stamping including an upper wall 55 and a lower wall 57, the edges of which are joined together at 50 and 56, is positioned within the insulating material 40 prior to the time that is is formed, or cast. The inner extremities of the walls 55 and 57 are bent outwardly to form an arrow shaped configurations at 58, thus preventing the housing 54 from being pulled out of or away from the insulating material 60. A portion of a latching member hook 70 is shown in FIG. 2, which may be of a contruction similar to that disclosed in Burke U.S. Pat. No. 2,191,244, heretofore referred to. The hook 70, when the latch mechanism is operated, is adapted to engage with a pin 124 in the other section, or panel member, 36. Such a pin 124 is illustrated in the embodiment of FIG. 13. When the latching mechanism is operated by a suitable tool which is inserted through a hole 72 in wall member 38, the hook 70 is moved into or out of engagement with the pin 124.

Figure 4:
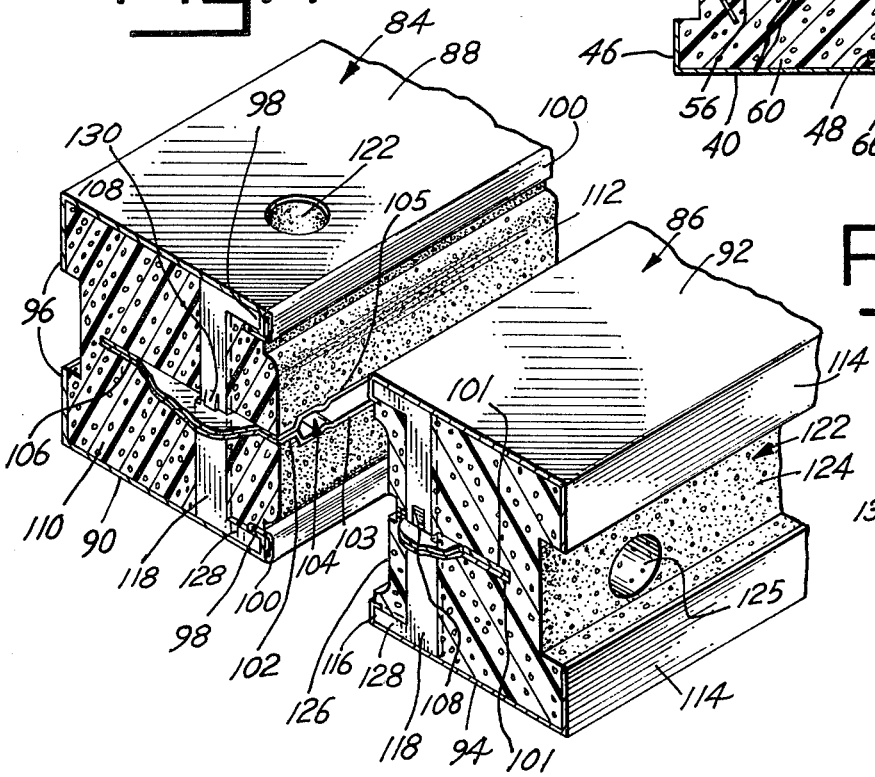
FIG. 4 is a perspective view of adjacent insulated panels of a building construction illustrating one embodiment of the invention.
Figure 5:
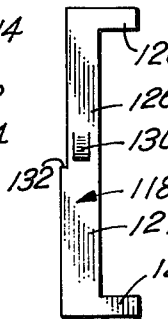
FIG. 5 is an elevational view of one of the positioning members which is attached to the latch supporting housing, which member is shown in FIG. 4.
Figure 6:
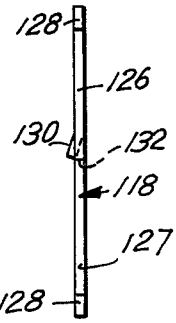
FIG. 6 is a side view of the member shown in FIG. 5.

Referring to the embodiment of the invention shown in FIGS. 4, 5 and 6, numeral 84 designates generally one panel embodying the invention and numeral 86 denotes generally an adjacent panel also embodying the invention, which is to be secured to the panel 84.

Panel 84 includes a top wall 88 and a bottom wall 90 preferably formed of metal and panel 86 includes a top wall 92 and a bottom wall 94, also preferably formed of metal. The left hand member in 84 in FIG. 4 is provided with right angle flanges 96 at one side of the walls 88 and 90 and with U-shaped channels 98 formed at the opposite sides of the walls 88 and 90. A seal 100, formed of rubber or similar material, is secured to the exterior of the channels 98 to seal the panels 84 and 86 together when they are finally assembled.

A latching member support housing 104 is embedded in molded, or cast, insulation 110 in the panel 84. The housing 104 is composed of a lower metallic member 103 and an upper metallic member 105 which are welded together at the edges of the housing 104 as shown at 102 and are also welded together along the sides of the extensions 101, which are embedded in the insulation 110. The extensions 101 are provided with a slot 108 therein for receiving a retaining or positioning member generally indicated at 118. The insulation 110 is bulged outwardly at 112 to cooperate with a depression 126 formed in insulation 122 in the panel 86. Furthermore, the insulation 122 has a channel 124 adjacent the adjacent flanges 114 which are turned at right angles toward each other on walls 92 and 94. A hole 125 is provided in the insulation 122 for the reception of a nut and bolt assembly (not shown), if desired. A latching hook 120 is pivotally mounted in the housing 104 in a manner similar to that described in the aforesaid prior art and is adapted to engage with a pin 124 (such as shown in FIG. 13) to tightly latch the members 84 and 86 together by drawing them toward each other.

The panel member 86 is also provided with channel-shaped grooves 116 on the opposite sides of walls 92 and 94 from the flanges 114. A positioning member 118 which is U-shaped is shown in detail in FIGS. 5 and 6 and includes an upper portion 126 and a slightly wider lower portion 127, thus providing a shoulder 132. The metal of the member 118 is knocked out to form a tab 130 so that when the member 118 is inserted into the slot 108 in the housing member 104, it will be positioned vertically by the shoulder 132 and tab 130, the tab 130 being sufficiently flexible to be forced through slot 108 so it cannot be withdrawn from the slot. The shoulder 132 prevents movement of the member 118 in the opposite direction in slot 108.

The panels 84 and 86 are both assembled in a similar manner by placing the assembled housing 104 which comprises the walls 103 and 105 and the extensions 101 in the insulation 110 before the insulation is cast or molded. The retaining members 118 are also positioned in the extensions 101 prior to the casting or molding of the insulation and are positioned so that the flanges or extensions 128 at the top and bottom of the retaining members 118 are in snug and positive contact with the U-shaped grooves 98 in the walls 88 and 90. Therefore, after the insulation is cast or molded, the housing 104 and its housing parts cannot pull out of the panel 84 even though the insulation 110 may deteriorate or crack since movement is prevented even though the hook 120 is engaging the pin 124 and is tending to bias the two panels 84 and 86 together.

The same situation is evident with respect to panel member 86 since the retaining members 118 have their extensions or flanges 128 contacting the channel members or grooves 116 on the inner side of the panel 86 and any tension which is exerted by operation of the latching means will tend to force the extensions 128 tightly into the grooves 116 so that the housing contained therein will not change its position when the latching mechanism is utilized.

Figure 7:
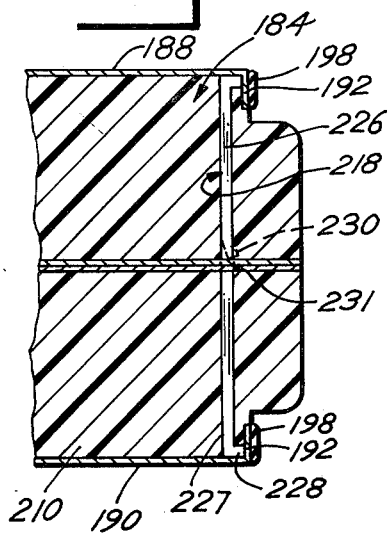
FIG. 7 is a partial sectional view of one of the panels similar to the left hand panel of FIG. 4 illustrating a second embodiment of the invention.
Figure 8:
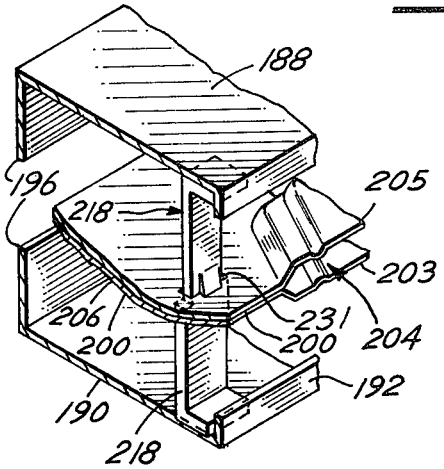
FIG. 8 is a partial perspective view of the construction shown in FIG. 7 with the insulation deleted.
Figure 9:
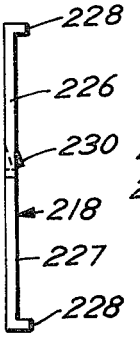
FIG. 9 is a side elevational view of the positioning member which is secured to the latch housing member of FIG. 8.
Figure 10:
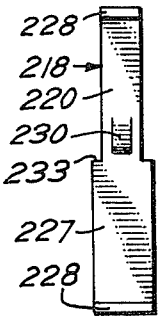
FIG. 10 is a front view of the member shown in FIGS. 7, 8 and 9.

Referring to FIGS. 7, 8, 9 and 10 for a detailed description of another embodiment of the invention, numeral 188 designates the upper wall of a panel generally indicated at 184 and numeral 190 designates the lower wall thereof, which walls 188 and 190 are preferably formed of metal. The ends of the walls 188 and 190 are bent at right angles to form flanges 192. The opposite ends of the wall 188 and 190 are formed with right angle flanges 196 as shown in FIG. 8. A gasket 198 of rubber or other suitable material is secured to the flanges 192 for sealing the panel 184 to an adjacent panel (not shown) in a manner described above.

A housing 204, preferably formed of metal, for supporting the latching mechanism, referred to in the embodiment shown in FIGS. 4, 5 and 6, includes a bottom wall member 203 and a top wall member 205 which are welded together as shown at 200. The walls 203 and 205 extend from the housing 204 into the insulation 210 in the panel 184, as best shown in FIG. 7.

A retaining member 218 similar to the retaining member 118 in FIGS. 5 and 6, except that it is turned 90° from the retaining members in FIGS. 4, 5 and 6, is provided with an upper portion 226 and a slightly larger portion 227 and with extensions or flanges 228 at the top and bottom thereof. A knock-out or tab 230 is stamped from the member 218 and when the member 218 is assembled, the tab 230 prevents vertical movement of the member 218 in one direction with respect to the walls 203 and 205. The member 218 extends through an opening 231 in the wall members and the difference in width of the portions 226 and 227 of the retaining member provide a shoulder 233 which prevents movement of the retaining member 218 upwardly with respect to the walls 203 and 205 since the shoulder 233 is wider than the slot 231.

The housing 204 shown in FIGS. 7–10 is assembled in the same manner as that shown in FIGS. 4, 5 and 6 and the retaining member 218 is forced against the flanges 192 on walls 188 and 190 when the latching mechanism 120, 124 is utilized so that the flanges or extensions 228 abut tightly against the flanges 192 and biasing caused by the latching mechanism tends to tighten the assembly and prevent movement thereof even though the insulation 210 may crack or deteriorate.

Figure 11:
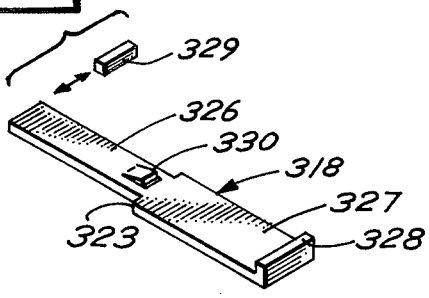
FIG. 11 is a perspective view of a positioning member to be secured to the construction shown in FIG. 12, including a magnet.
Figure 12:
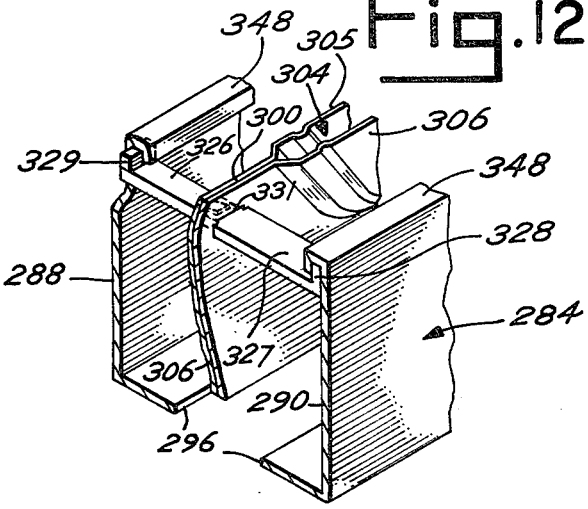
FIG. 12 is a partial perspective view of another embodiment of the invention with the insulation deleted and shows the assembly of the member shown in FIG. 11.

Referring to FIGS. 11 and 12 for a description of still another embodiment of the invention, a magnet 329 is utilized to assist in the assembly of the latch supporting housing and to retain the parts thereof in their proper position. In FIG. 12, walls preferably formed of metal are shown at 228 and 290 to form a panel assembly generally indicated at 284. Flanges 296 are formed along one side of the walls 288 and 290 and U-shaped grooves or channels 348 are formed at the other side of the walls 288 and 290 to engage with a retaining member 327 having a flange or extension 328 at one end which engages with the groove 348 in wall 290. The other end of the retainer 318 is not provided with a flange, but a magnet 329 is inserted between the end of the retainer 318 and the groove 348 in wall member 288 to retain the member 318 in position. The latch supporting housing 304 includes walls 305 and 306 which are welded together at 300 and which extend downwardly in this embodiment at 306 and are embedded in the insulation in the same manner as the other embodiments. The housing 304 likewise contains latching elements similar to those described in the other embodiments, but not shown herein. The retaining member 318 is provided with an upper portion 326 which is more narrow than the lower portion 327, thus providing a shoulder 323 which engages with one side of a slot 331 in the extension of the housing 306. A knock-out or tab 330 is provided in the portion 326 of the retainer 318 to provide a stop to prevent movement in one direction of the retainer 318 with respect to the slot 331 and extension 306.

Referring to FIG. 13 for description of another embodiment of the invention, a latch supporting housing 405 includes an upper, preferably metallic, wall 405 and a lower metallic wall 406. The walls are welded together at 400 and extensions are provided thereon as shown at 408 and 412 which are welded together as shown at 402. An upper U-shaped notch 410 is provided in the extensions 408 and lower U-shaped notches 414 are provided in the other extensions 412. The assembly of FIG. 13 when placed in a wall construction such as shown in FIG. 4 will operate in the same manner as shown in that Figure, except that the slots 410 and 414 will engage with the U-shaped channels similar to those shown at 98 in FIG. 4 and prevent movement of the housing 404 after it is assembled into a panel and the insulation cast or molded therein. A latching pin 124 is secured between the walls 405 and 406 and the latch or hook shown diagrammatically, for example, at 120 in FIG. 4 engages with the pin 124 when a tool (not shown) is inserted into the hole 102 to operate the hook 210 and cause it to engage or disengage with the pin 124 to provide for securing adjacent panels together or releasing them when desired.

From the foregoing, it will be apparent that there is provided a latch supporting structure for assembly of insulated wall panels which will stay in position and be practically immovable, even though the stresses of latching are applied thereto even though the insulation of the panels may crack or deteriorate.

Various modifications may be made in the form of the invention without departing from the principles disclosed in the foregoing. It is my intention therefore that the accompanying claims be construed as broadly as possible consistent with the prior art.

I claim as my invention:

1. A panel locking supporting means for each of a pair of adjacent panels to be joined together, each panel including a pair of relatively rigid wall members with heat insulating material disposed therebetween, said locking supporting means comprising a rigid housing having spaced sides and means for joining the edge portions of the wall members together, said housing further comprising extensions respectively extending from opposite ends of the spaced sides and having at least one slot for receiving retaining means therein, and elongated retaining means substantially perpendicular to said housing extending through said slot and having its ends positioned within said joined edge portions to positively position said housing with respect to said wall members.

2. A panel locking supporting means as claimed in claim 1 wherein said retaining means is formed of a separate piece of material which is substantially U-shaped and wherein the ends of the U engage with said edges of respective wall members and are embedded in said insulation.

3. A panel locking supporting means as said forth in claims 1 or 2 wherein said retaining means is detachably secured to the edge portions at opposite sides of the housing.

4. A panel locking supporting means as claimed in claim 3 wherein a magnet is inserted between said retaining means and one of said edge portions to retain the latter in assembled relationship with each other.

5. A panel locking supporting means as claimed in claim 1 wherein said retaining means comprises a U-shaped flat member in which the ends of the U's are adapted to engage with said respective edge portions and wherein means are provided on the said last means to enable securing the same to the attached edge portions, and means on said securing means formed to prevent relative movement of said retaining means relative to said edge portions after assembly.

6. A panel locking supporting means as claimed in claim 1 wherein said retaining means is formed of a substantially flat U-shaped member with the flat portion thereof in alignment with the edges of the wall members.

7. A panel locking supporting means as claimed in claim 1 wherein said retaining means comprises a flat U-shaped member wherein the flat portion extends substantially parallel to the edge portions of said respective wall members.

8. A panel locking supporting means for mounting one of a pair of adjacent panels to be secured together, said panels each including a pair of relatively rigid wall members with heat insulating material disposed therebetween, means formed on at least one edge of each of the wall members on edges which are in substantial alignment with each other, said locking supporting means comprising a housing consisting of two pieces of metal formed to provide spaced sides of the housing and adapted to be joined together at their edges, and also provided with an extension extending substantially at right angles from the portions forming the spaced sides of said housing, said extension having at least one slot for receiving retaining means therein, and retaining means supported on said right angle extensions having a portion positioned through said slot for positive engagement with said edge portions of the wall members after said insulation has been inserted.

9. A panel locking supporting means at set forth in claim 8 wherein at least one said adjacent panel is provided with means secured thereto for sealing it resiliently to the adjacent panel.

* * * * *